United States Patent [19]

Beffart et al.

[11] 4,442,686

[45] Apr. 17, 1984

[54] SUPPORT TUBES FOR CROSS-WOUND COILS AND CROSS-WINDINGS

[75] Inventors: Hans Beffart, Mörlenbach-Voech; Hans M. Ries, Jockgrim, both of Fed. Rep. of Germany

[73] Assignee: Firma Carl Freudenberg, Weinheim, Fed. Rep. of Germany

[21] Appl. No.: 374,060

[22] Filed: May 3, 1982

[30] Foreign Application Priority Data

Jun. 19, 1981 [DE] Fed. Rep. of Germany ..... 3124135

[51] Int. Cl.[3] ..... D06B 23/04; B65H 75/18

[52] U.S. Cl. ..... 68/198; 242/118.1

[58] Field of Search ..... 242/118.1, 118.11, 118.2, 242/118.3, 118.31, 118.32; 68/198

[56] References Cited

U.S. PATENT DOCUMENTS 2,219,836 10/1940 Dunlap ..... 242/118.32
2,328,335 8/1943 Fryer et al. ..... 242/118.2
2,394,639 2/1946 Seem ..... 242/118.1 X
3,672,598 6/1972 Saveth ..... 242/118.32 X
3,997,929 12/1976 Schultheiss et al. ..... 68/198 X

FOREIGN PATENT DOCUMENTS 1136984 1/1957 France ..... 242/118.32

*Primary Examiner*—Philip R. Coe
*Attorney, Agent, or Firm*—Kenyon & Kenyon

[57] ABSTRACT

A support tube for cross-wound coils and cross-wound windings for the bleaching and dyeing of shrinking yarns consisting of a strip, closed in itself, of a porous, elastic two-layer nonwoven fabric of synthetic fibers and/or endless fibers which are joined to each other, where the lower layer has a corrugation oriented parallel to the longitudinal direction, and the upper layer covers the folds formed by the corrugation on the outside and is connected firmly to the lower layer in the region of the largest diameter of the folds.

14 Claims, 4 Drawing Figures

FIG. 1
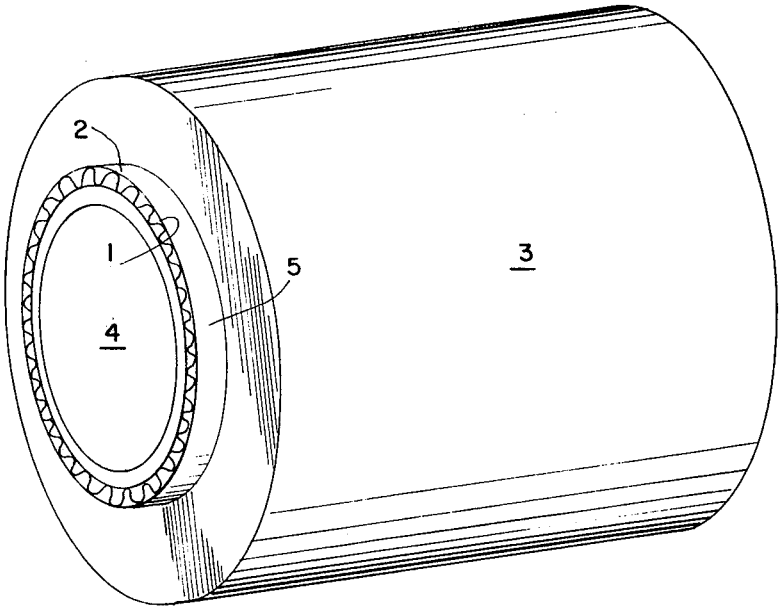
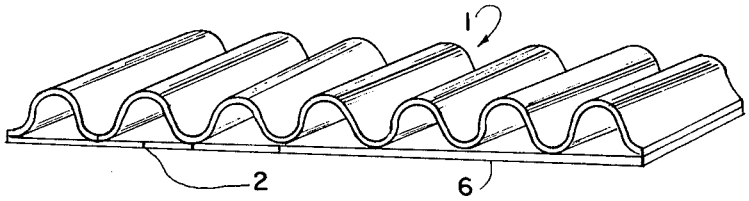
FIG. 2

SUPPORT TUBES FOR CROSS-WOUND COILS AND CROSS-WINDINGS

BACKGROUND OF THE INVENTION

The present invention relates to a support tube for cross-wound coils and cross-windings for bleaching and dyeing shrinking yarns, consisting of a strip, closed in itself, of a porous, elastic nonwoven fabric of synthetic fibers and/or endless fibers which are connected to each other.

A support tube of the type mentioned above is known from DE-OS 22 47 751. The support tube consists of a thickwalled hollow cylinder or hollow cone of an elastic nonwoven fabric, the wall thickness of which is made so that the yarn winding taken-up is securely held from the start without adverse effect from the diameter reduction resulting from the shrinkage. Because of the large fiber volume, the cost of the materials for such a support tube is relatively high. In addition, the compression of the wall thickness of the support tube due to the shrinkage of the yarn thereon can result in a reduction of the pore volume and, in particular, of the pore radii, of the nonwoven fabric, which has an adverse effect on the permeability of the fabric and, therefore, on the uniformity with which the individual layers of the yarn winding are acted on by the subsequent treatment (i.e., dyeing or bleaching) liquor.

SUMMARY OF THE INVENTION

It is an object of the present invention to develop a support tube of the type mentioned at the outset such that the mentioned disadvantages no longer occur in production and the cost of the materials is reduced.

According to the present invention, this and other objects are achieved by the provision of a support tube which comprises two distinct layers bonded to each other. The so-called lower layer of the support tube is a cylindrical layer of a porous elastic nonwoven fabric of synthetic fibers (and/or endless fibers) which are cemented together. The lower layer is corrugated in the longitudinal direction along the length of the cylinder. The so-called "upper layer", against which the yarn is taken up, covers or surrounds the lower layer and itself consists of a cylindrical layer of a porous elastic nonwoven fabric of synthetic fibers and/or endless fibers cemented together to form a continuous surface. The upper layer is attached to the lower layer, e.g., at the points of the lower layers where the corrugation folds are of their largest area.

The nonwoven fabric of the support tube of the present invention is constructed of two layers and consists of an upper and lower layer, where the lower layer has a plissé (corrugation) oriented parallel to the longitudinal direction, and the upper layer covers the folds formed by the corrugation on the outside, and is firmly connected to the lower layer in the region of the largest diameter of the folds. The wound-up yarn rests on the continuous outside, closed in itself, of the upper layer which consists of a soft light-weight nonwoven fabric with particularly high permeability for liquids. The flexibility is fixed so that a good fit to the innermost yarn layers of the accepted winding is obtained. This winding is thereby secured in an excellent manner and sliding-off in the axial direction at an undesirable time can thereby largely be precluded.

Through the corrugation of the lower layer, which is firmly connected to the upper layer, a pressure exerted on the innermost yarn layers is achieved which is largely constant over the course of the entire shrinking of the yarn winding which takes place during the treatment. Undesirable deformations, for example, flattening of the innermost yarn layers, are thereby reliably prevented. The treatment liquor can at the same time act with the same intensity on all the layers of the wound-up yarn, independently of the shrinkage that has already occurred. This is of great practical importance with respect to ensuring uniform treatment, for example, uniform dyeing.

Special savings in material can be obtained if the fibers of the upper and/or lower layer are oriented predominantly in the circumferential direction. In such a case, the amount of fibers required in the longitudinal direction is only that required to ensure good internal ability.

The permeability of the nonwoven fabrics employed is favored by small thickness of the upper and lower layers. The thickness of these layers should not exceed the range of about 0.2 to 2 mm and preferably 0.2 to 0.8 mm.

The bending stiffness of the lower layer should exceed that of the upper layer, preferably by three to six times. This design ensures, on the one hand, good conformity of the upper layer to the innermost wound up yarn layers and, on the other hand, an especially well equalized pressure over the range of the shrinkage occurring in typically employed yarns.

In order to prevent displacement of the innermost yarn layers during the starting-up of the winding and later handling, it has been found to be advantageous if the upper layer has a roughened outside. The roughening may consist of fibers which stand off from the surface of the upper layer, such as can be obtained, for example, by a needling operation performed from the inside. The roughening also can be achieved by sprinkling or printing sinterable powders on the outside surface of the upper layer. Preferably, a polyamide powder with a diameter of 100 to 400 m, referred to the largest cross section, is used for this purpose.

The corrugation of the lower layer can be shaped differently and may be carried out, for example, either with sharp edges or rounded in the region of the inner and/or outer circumference. A design with sharp edges ensures more precise securing of the accepted yarn winding; the rounded design, on the other hand, allows the attainment of uniform pressures for larger shrinkage distances. Through a combination, in which, for example, the inner edges of the fold are made with sharp corners and the outer edges of the folds are rounded, both advantages can be combined. A reverse design, in which the inner fold edges are rounded and the outer fold edges are made with sharp corners, also is directly advantageous, depending on the circumstances of the individual case.

The upper and the lower layers preferably are joined together by welding or cementing zones. By comparison, sewing the layers together has been found to be technically more expensive and has the further disadvantage that the fibers of the upper and/or lower layer, which preferably extend in the circumferential direction, are not bound sufficiently stiffly at the ends. The welding or cementing zones can be made continuous without difficulty.

The ratio of the mutual spacing of the welding or cementing zones and the depth of the corrugation, as measured in the radial direction, should preferably be 0.2 to 4.0 and preferably 1.5 to 2.5. The ratio predominantly determines the forces active in the force triangle which is formed of each individual fold open toward the outside, and the portion of the upper layer bridging the former. The surfaces of the fold are subjected in this force triangle to a compression load acting parallel to its direction, on which a bending stress may be superimposed, depending on the design of the edges of the fold. Within the range given, good stability is achieved with advantageous material consumption.

DESCRIPTION OF THE FIGURES

FIG. 1 is a perspective view of the support tube of this invention including wound-up yarn.

FIG. 2 is a perspective view of corrugated material useful to make the support tube (4) shown in FIG. 1.

DETAILED DESCRIPTION OF THE INVENTION

Figure 4:
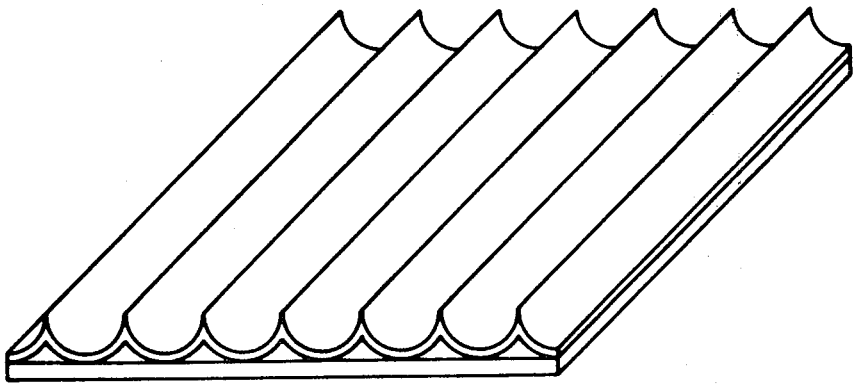
FIGS. 3 and 4 are corrugated materials having sharply contoured folds in the outer (FIG. 3) and inner (FIG. 4) direction.
Figure 3:
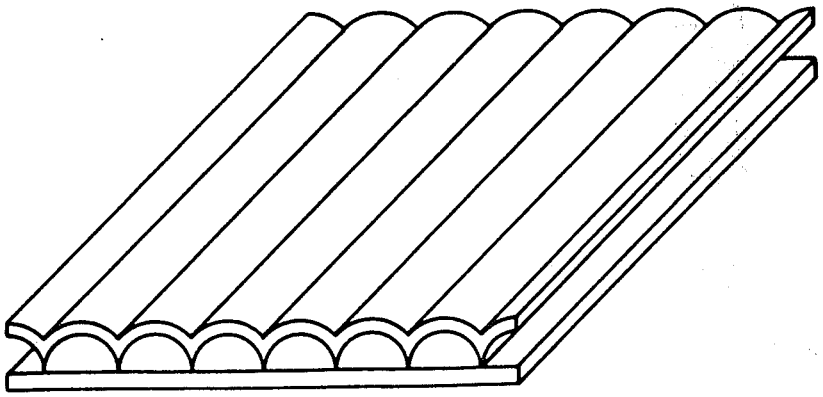

An example of an embodiment of the support tube of the invention is shown in the attached drawing.

FIG. 1 shows the support tube 4 with the wound-up yarn winding 3. The support tube 4 consists of the corrugated lower layer 1, which is welded undetachably to the upper layer 2 in the region of the largest diameter of the edges of the fold. A plastic powder 5 is sprinkled on the outside of the upper layer and is sintered-on by a thermal treatment. The inside diameter of the corrugated layer 1 is carried on a metallic centering sleeve, not shown.

The starting material for making a support tube according to FIG. 1 is shown in FIG. 2. It consists of the corrugated lower layer 1 which is joined to the upper layer 2 in the region of welding zones which are parallel to the folding edges. The material is rolled up in such a manner that the corrugations 1 form the inside, and is welded, cemented or sewed to a cylindrical support tube in the region of the outside circumference. A conical design with correspondingly shaped folding edges is possible without difficulty.

EXAMPLE

The support tube consists of a corrugated lower layer of a stiff first nonwoven fabric and an upper layer, connected thereto, of a second nonwoven fabric which has a soft flexible feel and high surface roughness.

The first nonwoven fabric is a spun polyester fabric with an area weight of 200 g/m$^2$ and a titer between 10 and 12 dtex. The individual elements are endless and random-oriented which results in the physical properties being equivalent in any direction, particularly tear strength and elasticity. The thickness of the fabric is 0.5 mm.

The second nonwoven fabric is a soft flexible carded fabric with high surface roughness, which ensures optimum yarn adhesion when the yarn is wound up. Thirty percent (30%) of the second nonwoven fabric consists of viscose fibers with a titer of 1.3 and a length of 40 mm, 10% consists of polyester fibers which have a titer of 3.3 dtex and a length of 60 mm, and 60% consists of nylon fibers which have a titer of 3.3 dtex and a length of 51 mm. The net fiber content is 35.8 g/m$^2$. The fibers are oriented predominantly in the circumferential direction and are cemented together by a bonding agent of 19.2 g/m$^2$ applied in the form of foam. The thickness of the layer is 0.4 mm. The fabric was needled-through from below for improving the surface roughness, and was sprinkled on the outside with 24 g/m$^2$ of a polyamide powder which was sintered-on by a thermal post-treatment.

The first nonwoven fabric is conducted at a temperature of 120° C. through a serrated pair of pressure rolls and is corrugated in the process, whereby a corrugation depth of 4.2 mm is obtained with a mutual distance of the individual folds of 8 mm. The profile of the folded edges is rounded on both sides.

The flat second nonwoven fabric is applied to the so-obtained corrugated material. The thermal welding along the fold edges is accomplished in the manner shown in FIG. 2, i.e., without appreciable change of shape of the two nonwoven fabrics.

Depending on the dimensions of the tube desired, the material obtained is cut to a given size, is rolled up to form a hollow cylinder with inward pointing folds which extend parallel to the axis according to FIG. 1 and is welded in the region of the outside circumference in the axial direction. The tube obtained can be used immediately.

What is claimed is:

1. A cylindrical or conical support tube for taking up shrinkable yarns which are thereafter subjected to bleaching or dyeing while on said support tube, comprising a cylindrical or conical lower layer of a porous elastic non-woven fabric of synthetic fibers and/or endless fibers which are cemented together, said lower layer being corrugated in the direction parallel to the longitudinal direction of said tube, and an upper layer of a porous elastic non-woven fabric of synthetic fibers and/or endless fibers which are cemented together to form a continuous cylindrical or conical surface, said upper layer covering said lower layer and being connected thereto at the areas of the largest diameter of the folds in said corrugated lower layer.

2. The support tube of claim 1 wherein said upper and lower layers consist of fibers which extend predominantly in the circumferential direction.

3. The support tube of claim 1 wherein the bending stiffness of said lower layer is greater than that of said upper layer.

4. The support tube of claim 3 wherein the bending stiffness of said lower layer is about 3 to 6 times that of said upper layer.

5. The support tube of claim 1 wherein the outer facing surface of said upper layer, which is in contact with the first windings of yarn, is roughened.

6. The support tube of claim 5 wherein said roughened outer facing surface of said upper layer contains fibers standing off from said surface.

7. The support tube of claim 5 wherein said roughened outer facing surface of said upper layer contains a powdered polymeric material sintered thereon.

8. The support tube of claim 1 wherein said corrugation consists of sharply contoured folds of said lower layer in the outer and/or inner direction.

9. The support tube of claim 1 wherein said corrugation consists of rounded folds of said lower layer in the outer and/or inner direction.

10. The support tube of claim 1 wherein said upper and lower layers are joined together by welding or cementing zones.

11. The support tube of claim 10 wherein said welding or cementing zones are continuous.

12. The support tube of claim 10 wherein the ratio of the distance of the welding or cementing zones to the depth of the corrugation is about 0.2 to 4.1.

13. The support tube of claim 1 wherein said lower layer has an area weight of 150 to 300 g/m$^2$ and a thickness of 0.2 to 0.8 mm and consists of autogeneously cemented endless polyester fibers having a titer of 8 to 20 dtex.

14. The support tube of claim 1 wherein said upper layer has an area weight of about 60 to 90 g/m$^2$ and a thickness of 0.2 to 0.8 mm and consists of staple fibers having a titer of 1.2 to 1.5 dtex which are cemented together by a bonding agent.

* * * * *